United States Patent [19]

Hadersbeck et al.

[11] Patent Number: 4,906,346

[45] Date of Patent: Mar. 6, 1990

[54] ELECTROPLATING APPARATUS FOR PRODUCING HUMPS ON CHIP COMPONENTS

[75] Inventors: Hans Hadersbeck; Ernst Andrascek, both of Munich, Fed. Rep. of Germany

[73] Assignee: Siemens Aktiengesellschaft, Berlin and Munich, Fed. Rep. of Germany

[21] Appl. No.: 153,318

[22] Filed: Feb. 8, 1988

[30] Foreign Application Priority Data

Feb. 23, 1987 [DE] Fed. Rep. of Germany ..... 3705727

[51] Int. Cl.[4] ..... C25D 17/00; C25D 17/06

[52] U.S. Cl. ..... 204/238; 204/297 W

[58] Field of Search ..... 204/237, 238, 276, 297 W

[56] References Cited

U.S. PATENT DOCUMENTS

| | | | |
|---|---|---|---|
| 4,137,867 | 2/1979 | Aigo | 118/627 |
| 4,170,959 | 10/1979 | Aigo | 118/627 |
| 4,339,319 | 7/1982 | Aigo | 204/275 |
| 4,466,864 | 8/1984 | Bacon et al. | 204/15 |

FOREIGN PATENT DOCUMENTS

| | | | |
|---|---|---|---|
| 0144752 | 6/1985 | European Pat. Off. . | |
| 28829 | 2/1983 | Japan | 204/242 |

OTHER PUBLICATIONS

Electroplating Engineering Handbook, Edited by A. Kenneth Graham, 1962, p. 724.

*Primary Examiner*—T. M. Tufariello

*Attorney, Agent, or Firm*—Hill, VanSanten, Steadman & Simpson

[57] ABSTRACT

The present invention provides an improved electroplating apparatus having an electroplating cell equipped with an anode, cathode and diaphragm ring. The electroplating cell is suspended in an electrolytic bath. The cell is composed of a plastic tube whose lower opening is covered by an anode surface and whose upper opening is covered by a wafer holder for holding the semiconductor wafer. The electroplating apparatus further includes an activated carbon filtering aimed at the levelling effect.

9 Claims, 3 Drawing Sheets

ELECTROPLATING APPARATUS FOR PRODUCING HUMPS ON CHIP COMPONENTS

BACKGROUND OF THE INVENTION

The present invention relates generally to an electroplating apparatus. More specifically, the present invention relates to an apparatus for producing finely structured, thick metal depositions on semiconductor wafers.

Humps, electroplated onto a chip component, that project above the chip surface are required for micropack technology, a format for integrated circuits. Typically, these humps project approximately 18 um above the chip surface. In plan view, the hump generally possesses a quadratic shape, whereby the lateral edges exhibit a length of approximately 140 um, 100 um and below. Despite an unfavorable starting basis that depressions of a maximum of 8 um up to the terminal pad are prescribed in the central region of the humps, the hump surface should be nearly planar.

Due to the macro-scatter capability, it is not possible with known electroplating apparatus to achieve a sufficient uniformity of hump height over the surface of the semiconductor wafer. For exaple, for a 100 mm semiconductor wafer, it is not possible with known apparatus to achieve a uniformity of 1.0 um for the hump height over the surface with the exception of a narrow edge region. Among those factors which define the scatterability, the geometrical properties of the system which determine the primary current distribution must be cited first. Included among the geometrical properties are the geometrical formulas of the anode, cathode and electrolyte vessel as well as the arrangement of the electrodes in the electrolyte vessel and their distance from the vessel walls.

The electroplating apparatus for producing finely structured, thick metal depositions on semiconductor wafers must not only achieve, to the extent possible of uniformity of hump height over the surface, but also guarantee a reproducible, uniformly good metal deposition over a period of months. Furthermore, decomposition products that hinder a good metal deposition must be prevented from collecting.

Accordingly, there is a need for an electroplating apparatus that can meet the extreme requirements needed to produce semiconductor wafers.

SUMMARY OF THE INVENTION

The present invention provides an improved electroplating apparatus that fulfills the extreme requirements. The invention is based on the object of designing an electroplating apparatus for producing finely structured, thick metal depositions on semiconductor wafers. Despite an unfavorable starting basis, it is thereby required that the hump surface should be nearly planar and, moreover, that a uniformity of 1.0 mm should be achieved for the hump height. Further, the electroplating apparatus must guarantee a reproducible, uniformly good metal deposition over a period of months. The electroplating apparatus of the present invention makes it possible to produce humps having a nearly planar surface and to achieve a uniform metallization thickness over the entire region of a semiconductor wafer. Further, the electroplating apparatus of the present invention also guarantees a reproducible, uniformly good metal deposition over a period of months.

To this end, the electroplating apparatus of the present invention provides an electrolytic vessel for containing an electrolyte bath including a leveller. An electroplating cell is suspended within the bath. The cell has a top opening and a bottom opening, the bottom opening being covered by an anode. A semiconductor wafer holder, for holding a semiconductor wafer is received within the top opening. The apparatus includes an activated carbon filtering means for filtering out low-molecular constituents of the bath and leaving the high-molecular surface-active agents in the bath.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides an improved electrolyte apparatus for producing finely structured, thick metal depositions on semiconductor wafers. The apparatus includes an electrolyte vessel having leveller and an activated carbon filtering.

Figure 1:
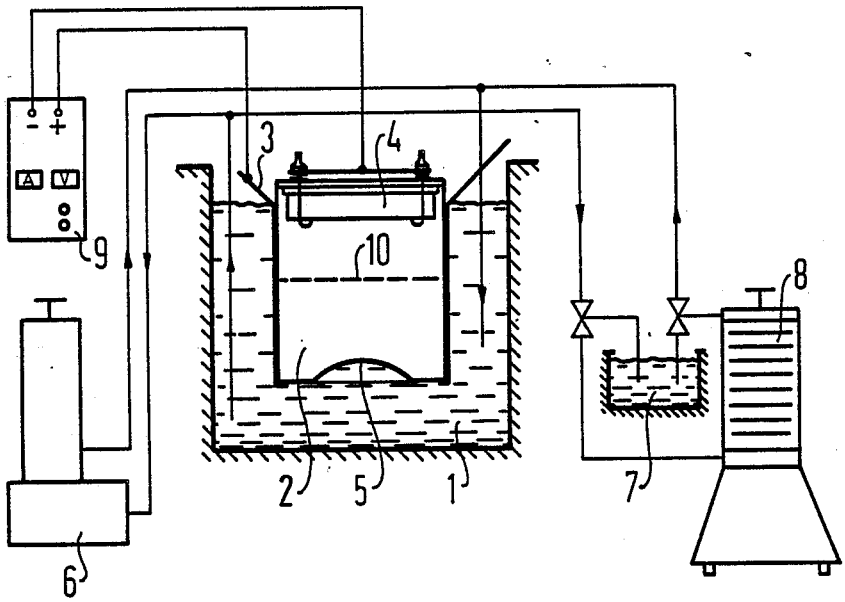
FIG. 1 illustrates a schematic view of an electroplating apparatus of the present invention.

Referring to FIG. 1, the electroplating apparatus of the present invention is illustrated and includes an electrolyte vessel 1. An electroplating cell 2 is suspended within the electrolyte vessel 1. Although only one electroplating cell 2 is illustrated in FIG. 1, the electrolyte vessel 1 can accept a plurality of electroplating cells 2. The electroplating apparatus of the present invention also includes an insulated anode lead 3; a wafer holder 4; and an anode 5. Located outside the electrolyte vessel 1 is a continuous circulation filter 6, for eliminating impurities, an activated carbon inbound vessel 7 and an activated carbon filter pump unit 8 that can be activated when desired. The power supply 9 supplies power via a currentvoltage constant.

Figure 2:
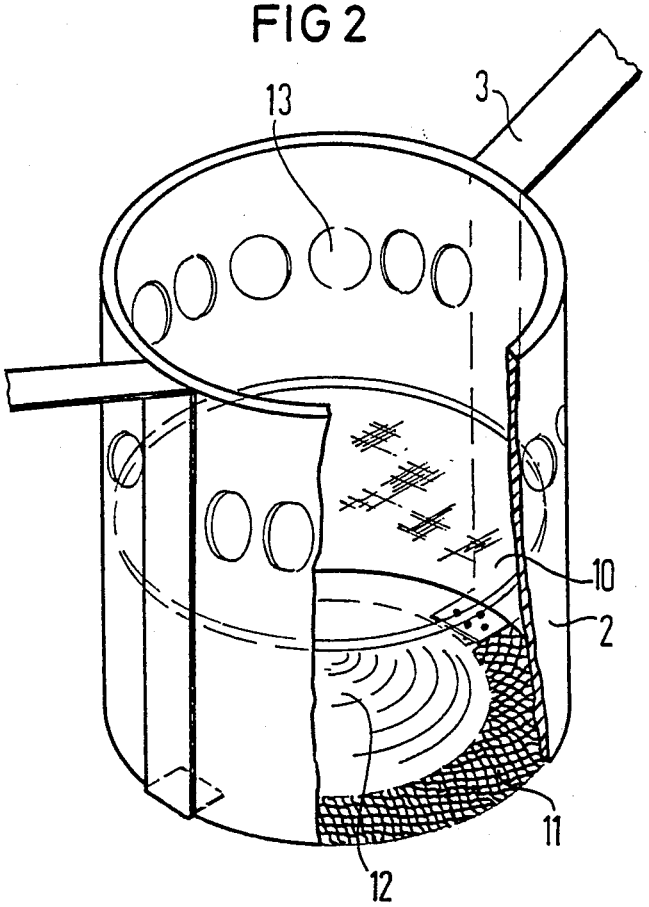
FIG. 2 illustrates a perspective view of an electroplating cell with parts broken away.

Referring to FIG. 2, the electroplating cell 2 is illustrated. The electroplating cell 2 is constructed from a plastic tube. As illustrated, the electroplating cell 2 is open at its top. Located in the electroplating cell 2 is a diaphragm 10 (the diaphragm 10 is also indicated by broken lines in FIG. 1). Shielding diaphragms or, respectively, porous discs (membranes) can also be inserted in the space between anode and disc holder, for example for uniform deposition or, respectively, filtering.

The electroplating cell 2 includes an anode lead 3 and anode 5. The plastic tube that defines the body of the electroplating cell 2 is also open at the bottom thereof. In order to generate a good current distribution, macroscatter, the anode surface 5 has a construction identical to the opening in the plastic tube of the cell 2. The anode 5 includes a calotte-shaped elevation 12 in the middle of a rib mesh anode 11. In an example of an electroplating cell 2 designed, in particular, for copper deposition, the rib mesh anode 11 was constructed from titanium. To this end, an insoluble titanium rib mesh anode 5 was constructed having the shape illustrated in FIG. 1 in order to promote a good current distribution. The required, soluble anode was filled into the rib mesh anode 5 in the form of copper granules or pellets. To allow for electrolyte exchange, flowthrough, into and out of the electroplating cell 2, the jacket of the cell includes openings 13 provided at the cathode level.

Figure 3:
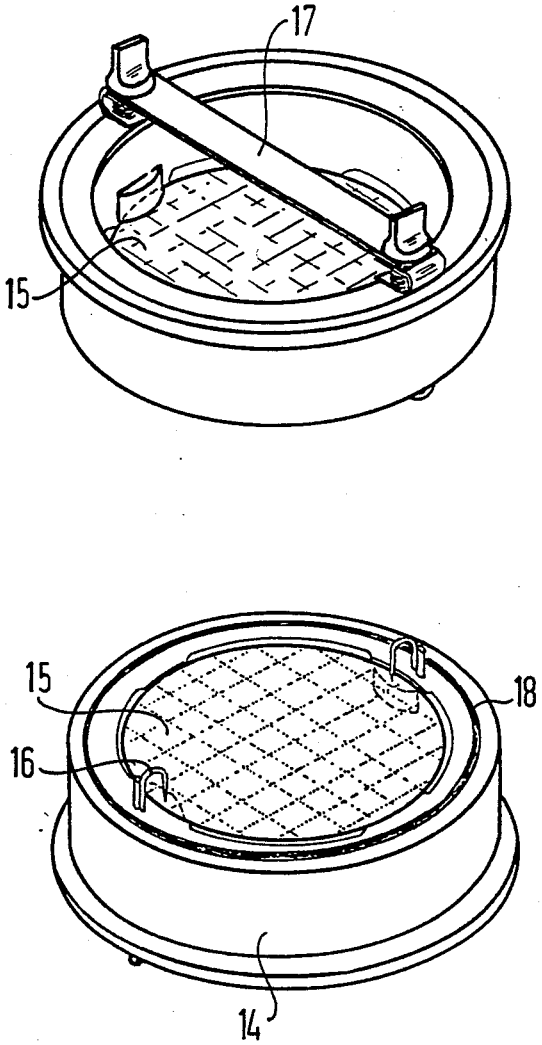
FIG. 3 illustrates top elevational and bottom elevational views of a wafer holder.

Referring to FIG. 3, the wafer holder 4 is illustrated. As illustrated in FIG. 1, the body 14 of the wafer holder 4 serves as an upper termination of the electroplating cell 2. The wafer holder 4 functions to hold the semiconductor wafers 15. As shown in FIG. 3, the wafers 15 are held in the wafer holder 4 by two contacting tips 16. The wafer holder 4 also includes a cathode terminal 17 electrically connected to the contacting tips 16 and an electroplating diaphragm ring 18 electrically connected to the cathode terminal 17 that surrounds the upper opening. Depending on requirements, the ring diaphragm 18 can be covered with an insulating lacquer, whereby the macro-scatter can also be optimized. An interior wall 19 of the wafer holder 4, consisting of insulating material, has inwardly extending projections 20 thereon, against which the semiconductor wafer 15 abuts, when in the holder 4. The interior wall 19 has a number of recesses 21 therein, to permit electrolyte flow around the wafer 4. The holder 4 has an outer wall 22, which is spaced from the inner wall 19 so as to form an annular channel, in which the diaphragm ring 18 is disposed.

As previously stated, impurities in the fluid can prevent proper metal deposition. In order to avoid these disrupting impurities, the electrolyte is constantly pumped through a multiple tube filter (mesh width $\leqq 10$ um) to achieve a continuous circulation filtering. A flow of the electrolyte in the direction indicated by the arrow in FIG. 1 is thereby achieved by the continuous pumping. Although it is necessary to eliminate impurities, the elimination of the decomposition products, however, is of greater significance for a good metal deposition.

In accordance with the present invention, a special activated carbon filtering $\frac{7}{8}$ is provided for the elimination of the decomposition products. Through the special activated carbon filtering of the present invention, the filtering ensues through use of a paper filter or, respectively, multiple tube filters saturated with an activated carbon which, in particular, absorbs the low-molecular constituents. By utilizing a daily, time-optimized activated carbon filtering, the decomposition products and the leveller are removed. By utilizing the appropriate activated carbon filter, the high-molecular surface-active agents are however preserved in the bath. The optimization refers to the selection of the correct relationship of the decomposition product and levellers arising daily with reference to the area of the activated carbon filter. Thus, for example, one liter of electrolyte should be pumped through a filter area of 1 $dm^2$ twelve times.

By way of example, in use, before the start of the electroplating process, the activated carbon filtering is first respectively carried out on a work day, whereby the decomposition products together with leveller are removed. The addition of approximately 0.1 to about 0.5 ml/l leveller into the electrolyte, that has been cleaned of decomposition products and used leveller, after the activated carbon filtering, functions to improve the quality of the metal deposition. The freshly added leveller has an extremely pronounced effect over a time span of approximately 1 day. After a day, however, the levelling effect noticeably decreases and the established depressions are again formed in a concave form ($<4$ um) at the hump surface. A further addition of leveller without the special activated carbon filtering no longer produces the greatly levelling effect but completely changes the deposition characteristic, so that an effect opposite levelling arises.

The present invention is not limited to the described and illustrated exemplary embodiment. For example, a brightener can be utilized instead of only leveller or both leveller and a brightener can be used.

It should be understood that various changes and modifications to the presently preferred embodiments described herein will be apparent to those skilled in the art. Such changes and modifications can be made without departing from the spirit and scope of the present invention, and without diminishing its attendant advantages. It is thereby intended that such changes and modifications be covered by the appended claims.

We claim:

1. An apparatus for electroplating a semiconductor wafer comprising:

a vessel adapted to contain an electrolytic bath;

an electroplating cell disposed in said vessel and having an anode forming a bottom of said cell and adapted to permit flow of said electrolytic bath therethrough, said cell having an opening in a top thereof; and a holder received in said opening in said top of said cell and having a central opening formed by an inner wall of insulating material and adapted to receive a semiconductor wafer to be electroplated so that said wafer is in contact with said electrolytic bath, said inner wall having a plurality of projections adapted to abut a semiconductor wafer received in said central opening of said holder, said holder further having an outer wall of insulating material which defines, in combination with said inner wall, an annular channel, said holder further having a diaphragm ring of electrically conductive material disposed in said annular channel, and said holder further having a plurality of point contacts adapted to hold a semiconductor wafer against said projections of said inner wall, and a cathode terminal electrically connected to said diaphragm plate and to said point contacts.

2. The electroplating apparatus of claim 1 wherein the electroplating cell is composed of an open plastic tube suspended in the electrolyte, and wherein said anode is a calotte-shaped anode extending over the full tube bottom opening and the upper opening being covered by said wafer holder with said semiconductor wafer.

3. The electroplating apparatus of claim 1 further comprising additional shielding diaphragms received in a space in said cell between the anode and the wafer holder.

4. The electroplating apparatus of claim 1 further comprising porous wafer membranes received in a space in said cell between the anode and the wafer holder.

5. The electroplating apparatus of claim 1 further comprising an insulating lacquer for diminutive covering said ring diaphragm.

6. The electroplating apparatus of claim 1 wherein the electroplating ring diaphragm extends outwardly along a circumference of the wafer holder to create an enlarged surface area for the wafer holder.

7. The electroplating apparatus of claim 1 wherein the anode comprises an insoluble titanium rib mesh anode and a soluble anode contained in said cell in contact with the mesh anode.

8. The electroplating apparatus of claim 1 wherein the electrolytic bath contains a leveller, and further comprising activated carbon filtering means for filtering low-molecular constituents out of the bath including remaining leveller and decomposition products and leaving high-molecular surface-active agents in the bath.

9. The electroplating apparatus of claim 8 wherein brightener is substituted in said electrolytic bath, at least in part, for said leveller.

* * * * *